US008911242B2

(12) United States Patent
Jeon et al.

(10) Patent No.: US 8,911,242 B2
(45) Date of Patent: Dec. 16, 2014

(54) ELECTRICAL COMPONENT HAVING AN ARRAY OF ELECTRICAL CONTACTS

(75) Inventors: Myoungsoo Jeon, Harrisburg, PA (US); Attalee Snarr Taylor, Palmyra, PA (US); Craig Warren Hornung, Harrisburg, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 228 days.

(21) Appl. No.: 13/411,813

(22) Filed: Mar. 5, 2012

(65) Prior Publication Data

US 2013/0231009 A1 Sep. 5, 2013

(51) Int. Cl.
*H01R 12/00* (2006.01)

(52) U.S. Cl.
USPC ..... 439/66

(58) Field of Classification Search
USPC ..... 439/71, 66, 82–83
See application file for complete search history.

(56) References Cited

U.S. PATENT DOCUMENTS 5,152,695 A * 10/1992 Grabbe et al. ..... 439/71
5,173,055 A 12/1992 Grabbe
5,772,451 A 6/1998 Dozier, II et al.
5,944,537 A 8/1999 Smith et al.
6,142,789 A 11/2000 Nolan et al.
6,965,245 B2 * 11/2005 Kister et al. ..... 324/754.07
7,357,644 B2 * 4/2008 Dittmann ..... 439/66
7,371,073 B2 5/2008 Williams
7,435,108 B1 10/2008 Eldridge et al.
7,530,814 B2 * 5/2009 Ramaswamy et al. ..... 439/66
7,675,301 B2 3/2010 Eldridge et al.
7,989,945 B2 8/2011 Williams et al.
8,033,835 B2 * 10/2011 Mulfinger et al. ..... 439/66
8,033,838 B2 10/2011 Eldridge et al.
8,215,966 B2 * 7/2012 Champion et al. ..... 439/66
8,287,287 B2 * 10/2012 Miwa ..... 439/66
8,382,487 B2 * 2/2013 Jeon et al. ..... 439/66
2004/0000428 A1 1/2004 Lii et al.

* cited by examiner

*Primary Examiner* — Xuong Chung Trans

(57) ABSTRACT

An electrical component including a substrate having opposite first and second sides and a plurality of vias extending into the substrate from the first side. The substrate has first conductive pads on the first side that are electrically connected to corresponding vias. The electrical component also includes a plurality of electrical contacts that are mounted to the substrate along the first side. Each of the electrical contacts includes a contact heel and a contact beam that extends from the corresponding contact heel and at least partially away from the first side. The contact heels are laser-welded to corresponding first conductive pads.

18 Claims, 7 Drawing Sheets

ELECTRICAL COMPONENT HAVING AN ARRAY OF ELECTRICAL CONTACTS

BACKGROUND OF THE INVENTION

The subject matter herein relates generally to an electrical component having a substrate with an array of electrical contacts along a surface of the substrate.

Various packages or devices exist within the computer industry that require interconnection to a printed circuit board. The devices may be profiled with arrays of 50 by 50 contacts or even greater. Given the plurality of lands, the centerline spacing, and given the force applied to the packages when mounting to the circuit board, accommodating the packages can lead to a variety of problems in practice.

Sockets exist within the market for the interconnection of such devices, where the sockets include a substrate having contacts terminated to one side of the substrate for connection to the package or device, and contacts or balls terminated to the other side of the substrate for connection to the printed circuit board. The contacts have centerline spacings that correspond with the spacing of lands or balls on the device. Some known sockets, such as the contact grid array system described in U.S. Pat. No. 7,371,073 to Williams, use a contact array that is bonded to a dielectric substrate, which is then bonded to an interposer substrate. The contacts are then plated to create a conductive path from the contacts to a conductive layer on the interposer substrate. A 3D photoresist process is used to plate the contact array and the substrate. The 3D photoresist process has a high cost and low yield associated therewith. Additionally, attachment of the substrate to the interposer substrate is time consuming. For example, the contact array and substrate are laminated to the interposer substrate, requiring a 1-2 hour cure time.

It may also be desirable to directly mount packages to a circuit board without the above-described sockets. For example, a contact array may be coupled to a surface of a circuit board (e.g., motherboard) and the packages may be directly mounted to the contact array on the circuit board. However, the manufacture of such contact arrays may experience the same time and cost problems noted above.

A need remains for an electrical component having an array of electrical contacts that can be manufactured in a cost effective and reliable manner.

BRIEF DESCRIPTION OF THE INVENTION

In one embodiment, an electrical component is provided that includes a substrate having opposite first and second sides and a plurality of vias extending into the substrate from the first side. The substrate has first conductive pads on the first side that are electrically connected to corresponding vias. The electrical component also includes a plurality of electrical contacts that are mounted to the substrate along the first side. Each of the electrical contacts includes a contact heel and a contact beam that extends from the corresponding contact heel and at least partially away from the first side. The contact heels are laser-welded to corresponding first conductive pads.

The plurality of electrical contacts may form a first contact array and the electrical component may include a second contact array that is mounted to the substrate along the second side. The second contact array may have a plurality of electrical contacts coupled to corresponding second conductive pads along the second side. Each of the electrical contacts of the second contact array may include a contact beam that extends at least partially away from the second side. Alternatively, the second contact array may include a plurality of solder ball contacts coupled to corresponding second conductive pads along the second side.

In other embodiments, the substrate may be a circuit board that has remote contacts that are located a distance away from a plurality of electrical contacts along the first side and that are configured to engage an electrical connector.

In another embodiment, a communication assembly is provided that includes an electronic package. The communication assembly also includes an electrical component having a substrate with a side that includes a plurality of conductive pads. The electrical component also includes a plurality of electrical contacts that are coupled to the side of the substrate. Each of the electrical contacts has a contact heel and a contact beam that extends from the corresponding contact heel and at least partially away from the side. The contact heels are laser-welded to corresponding conductive pads on the side of the substrate. The electronic package is configured to be mounted onto the side of the substrate so that package contacts engage and are electrically coupled to corresponding electrical contacts.

An electrical component is also provided that includes a substrate having a side that includes a plurality of conductive pads. The electrical component also includes a plurality of electrical contacts coupled to the side of the substrate. Each of the electrical contacts has a contact heel and a contact beam that extends from the corresponding contact heel and at least partially away from the side. The contact heels are joined to the corresponding conductive pads at plug-weld bonds.

DETAILED DESCRIPTION OF THE INVENTION

The subject matter herein relates to electrical components having a land grid array of electrical contacts (LGA) and methods of manufacturing the same. As used herein, the LGAs may be used with various types of electrical components. For example, the electrical component may be an interconnect having a substrate with opposite sides in which one of the sides includes an LGA and the other side includes an LGA, a ball grid array of electrical contacts (BGA), or other contact array. The interconnect could be a chip interconnect for connecting a chip (or electronic package) to a printed circuit board. The electronic package may be, as one example, an application-specific integrated circuit (ASIC) configured to receive input data signals, process the input data signals, and provide output data signals. The interconnect could also be a board-to-board interconnect. In some embodiments, the electrical component may be a circuit board (e.g., motherboard) having an LGA thereon. In such embodiments, an electronic package may be coupled directly to the LGA on the circuit board, and other electronic device(s) that are mounted to the circuit board may be communicatively coupled to the electronic package through traces in the circuit board.

Figure 1:
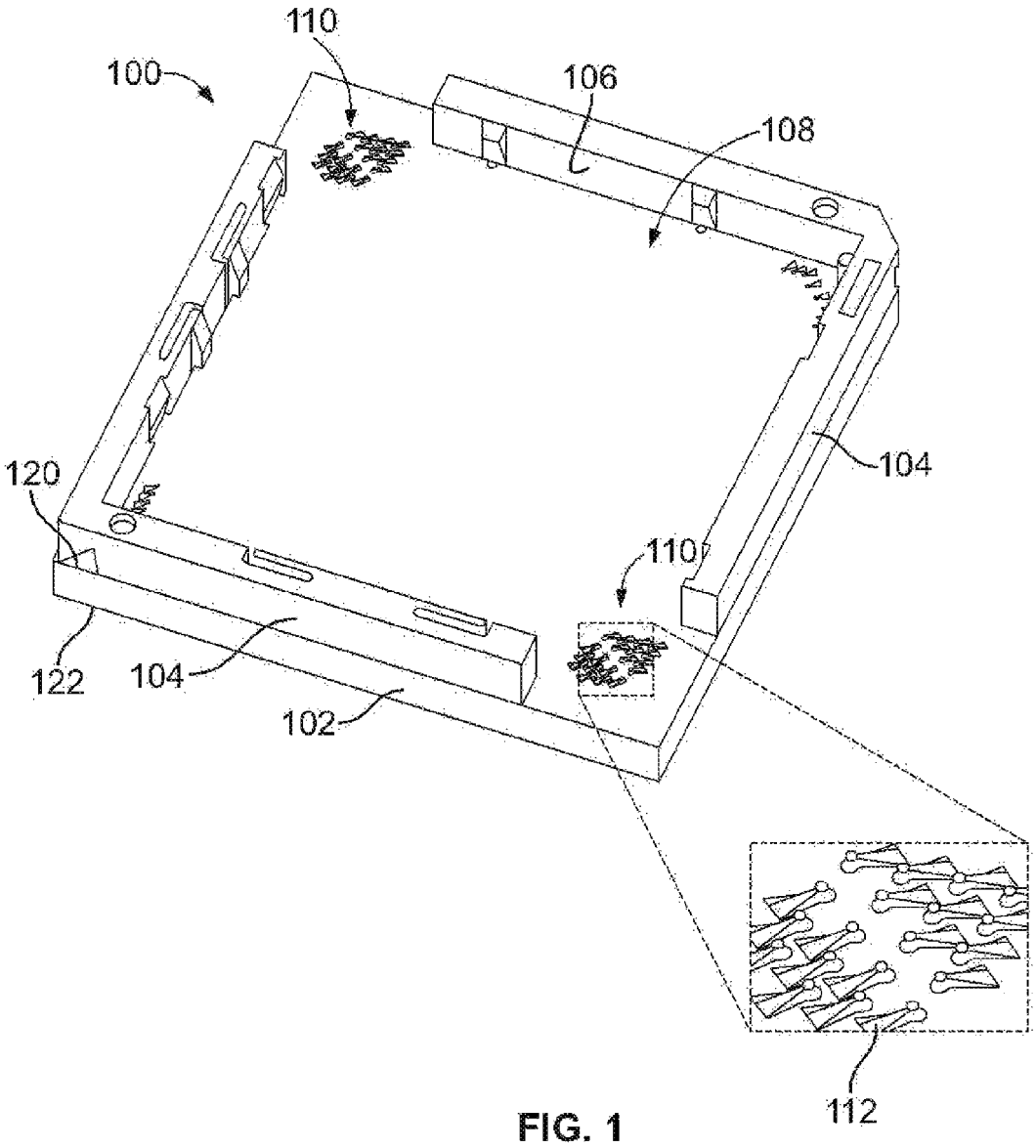
FIG. 1 is top perspective view of an electrical component formed in accordance with an exemplary embodiment.

FIG. 1 is top perspective view of an electrical component 100 formed in accordance with an exemplary embodiment. In the illustrated embodiment of FIG. 1, the electrical component 100 is an interconnect that is configured to be located between two other components and transmit data signals between the two components. Optionally, electrical power may also be transmitted therethrough. The electrical component 100 includes a substrate 102. The substrate 102 may include a planar body that is manufactured from one or more dielectric materials, such as those used to manufacture printed circuit boards (PCB) (e.g., FR-4). The substrate 102 may include one or more layers of the dielectric material(s) and may also include vias, traces, and other conductive components. The electrical component 100 also includes a housing 104 having guide walls 106. The guide walls 106 define an inner receiving nest 108 that is configured to receive an electronic package (not shown), such as a LGA semiconductor package. The electrical component 100 defines a socket for receiving the electronic package. One or more contact arrays 110 are provided on the substrate 102. Each of the contact arrays 110 defines a separable interface in which the contact array 110 engages and communicatively couples with the electronic package in the receiving nest 108. A portion of one of the contact arrays 110 is enlarged to show a more detailed view of individual electrical contacts 112.

Each of the contact arrays 110 includes a plurality of the electrical contacts 112. Only a portion of the electrical contacts 112 and/or contact arrays 110 is shown in FIG. 1. For instance, the receiving nest 108 may be filled entirely with electrical contacts 112 in some embodiments. However, any number of electrical contacts 112 may be provided. The electrical contacts 112 are arranged in a predetermined pattern that corresponds with a pattern of lands (not shown) on the electronic package. In some embodiments, the electrical contacts 112 may be arranged in a plurality of contact rows.

The substrate 102 extends between a first side 120 and a second side 122. The contact arrays 110 are provided along the first side 120. The second side 122 is configured to be mounted to another component, such as a printed circuit board (not shown). The second side 122 may be soldered to the printed circuit board using an array of solder balls. Other attachment means are possible in alternative embodiments. In some alternative embodiments, a second contact array that is similar to the contact array 110 may be attached to the second side 122. In the illustrated embodiment, the housing 104 is mounted to the first side 120. Alternatively, the housing 104 may surround an outer perimeter of the substrate 102 such that the substrate 102 is received within the housing 104.

Figure 2:
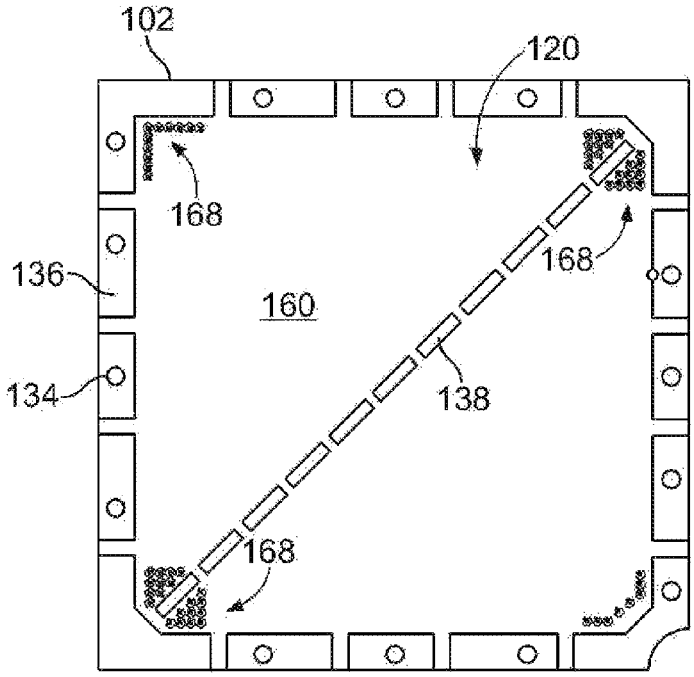
FIG. 2 is a top plan view of a substrate that may be used with the electrical component of FIG. 1.

FIG. 2 is a plan view of the first side 120 of the substrate 102. The substrate 102 has a first surface 160 along the first side 120. The first surface 160 may include one or more pluralities (or arrays) of conductive pads 168. As shown, a corresponding plurality of conductive pads 168 is located in each corner of the substrate 102. However, the conductive pads 168 may be distributed throughout the first surface 160. For example, larger portions of the first surface 160 or an entire area of the first surface 160 may have conductive pads 168 thereon.

The substrate 102 may include enlarged pads 136, 138 located along the first surface 160. The enlarged pads 136, 138 may be used to provide an electrical path for grounding and/or power transmission. The enlarged pads 136, 138 may also be used to facilitate mounting the guide walls 106 (FIG. 1). By way of example, the enlarged pads 136, 138 may include copper and be about 0.75 mm thick. Also shown, the substrate 102 includes a plurality of post holes 134. The post holes 134 extend through the enlarged pads 136 and the dielectric material of the substrate 102. The post holes 134 are configured to receive corresponding posts (not shown) of the guide walls 106. In some embodiments, the post holes 134 are distributed around an outer periphery of the substrate 102 as shown in FIG. 2. Alternatively, at least some of the post holes 134 may be located through a middle of the substrate 102 or other interior portion of the substrate 102.

Figure 3:
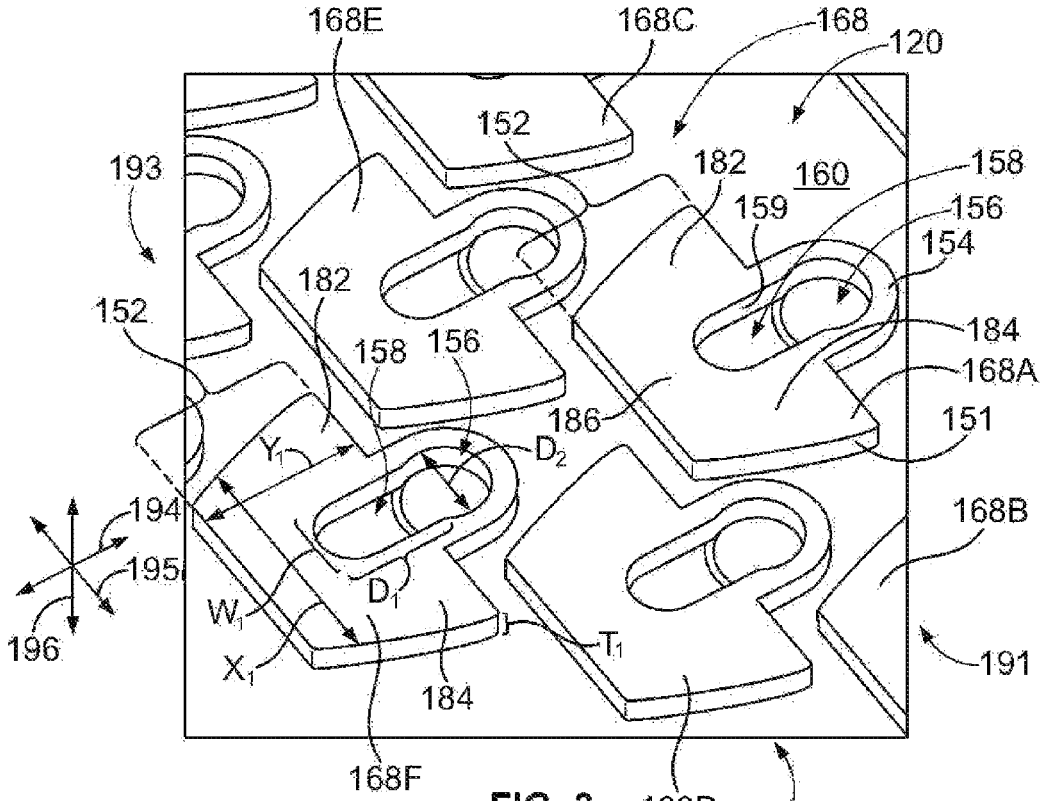
FIG. 3 is an enlarged perspective view of the substrate illustrating conductive pads in greater detail.

FIG. 3 shows an enlarged perspective view of the first side 120 with a plurality of the conductive pads 168 on the first surface 160. As shown, there are three pad rows 191-193 of conductive pads 168. Each of the pad rows 191-193 includes at least two conductive pads 168. The conductive pads 168 may be characterized as being adjacent to other conductive pads 168 in the same pad row and adjacent to other conductive pads 168 in different pad rows. When conductive pads in the same pad row are adjacent to each other, there are no intervening conductive pads in the same pad row that extend substantially between (e.g., more than halfway between) the adjacent conductive pads. For example, the conductive pad 168A is adjacent to the conductive pads 168B and 168C in pad row 191 even though the conductive pad 168D extends partially between the conductive pads 168A, 168B and the conductive pad 168E extends partially between the conductive pads 168A, 168C. When conductive pads in different pad rows are adjacent to each other, there are no intervening conductive pads that extend substantially between the adjacent conductive pads. For example, the conductive pad 168A of the pad row 191 is adjacent to the conductive pads 168D and 168E of the pad row 192.

In FIG. 3, the conductive pads 168 are oriented with respect to mutually perpendicular axes 194-96. The pad rows 191-193 extend lengthwise along the axis 195. As shown, the conductive pads 168 in adjacent rows 191-193 may be staggered with respect to each other. When staggered, the conductive pads 168 from one row may extend partially between conductive pads 168 from the next (or adjacent) row, thereby enabling a greater density of the conductive pads 168 compared to an embodiment wherein the conductive pads 168 in adjacent rows are linearly aligned.

Although the following is described with reference to the conductive pad 168A, other conductive pads 168 may have similar structures. However, the conductive pads of the first side 120 are not all required to have the same structure. For instance, the contact array 110 (FIG. 1) may have some conductive pads 168 as described herein and the contact array 100 may have other conductive pads with a different structure.

In the illustrated embodiment, the conductive pad 168A includes one or more layers of conductive material (e.g., copper) that is defined by a pad edge 151 that projects away from the first surface 160. The conductive pad 168A may include a base support 152 and a via rim 154 that extends away from the base support 152. The base support 152 is configured to mechanically support and be electrically connected to a corresponding electrical contact 112 (FIG. 1). The via rim 154 surrounds an opening 156 to a via 164 (shown in FIG. 8).

As shown, a suction channel 158 extends from the opening 156 into the base support 152. The suction channel 158 and the opening 156 are fluidly coupled such that air from within the suction channel 158 may be drawn into the via 164 through the opening 156. The suction channel 158 and the opening 156 are defined by a channel edge 159. In the illustrated embodiment, the channel edge 159 completely surrounds and defines the suction channel 158. In alternative embodiments, the channel edge 159 may include small openings that open along the first surface 160. The base support 152 may also include wing portions 182, 184 that are located on opposite sides of the suction channel 158 and extend away from each other. The wing portions 182, 184 are coupled to each other by a center portion 186 of the conductive pad 168A.

With respect to a conductive pad 168F, the base support 152 has a first dimension $X_1$ that is measured in a direction along the axis 195. The base support 152 also includes a second dimension $Y_1$ that is measured along the axis 194 and a pad thickness $T_1$ that is measured along the axis 196. In particular embodiments, the first dimension $X_1$ may reduce or taper as the base support 152 extends away from the opening 156. For example, the wing portions 182, 184 may be shaped to curve toward each other as the base support 152 of the conductive pad 168F extends away from the opening 156. The second dimension $Y_1$ may be substantially uniform throughout except for near the outer regions of the wing portions 182, 184. The pad thickness $T_1$ may be substantially uniform throughout.

In the illustrated embodiment, the suction channel 158 extends a distance $D_1$ along the axis 194. The suction channel 158 may have a width $W_1$ and the opening may have a diameter $D_2$. The various dimensions of the conductive pads 168, including the dimensions $X_1$, $Y_1$, $T_1$, $D_1$, $W_1$, and $D_2$, may be configured for different purposes. For example, the dimensions $X_1$ and $Y_1$ may be configured to permit a greater density of conductive pads and/or to provide a larger area for welding the electrical contact 112 (FIG. 1) to the corresponding conductive pad 168. The dimensions $D_1$, $W_1$, and/or $D_2$ may be configured to provide a sufficient suction force during manufacture of the electrical component 100 as described below. The pad thickness $T_1$ may be configured to be suitable for laser-welding the electrical contact 112 to the conductive pad 168. For example, the pad thickness $T_1$ may be at least about 1.25 times a heel thickness $T_2$ (shown in FIG. 5) of the electrical contact 112 that is welded to the conductive pad 168.

Figure 5:
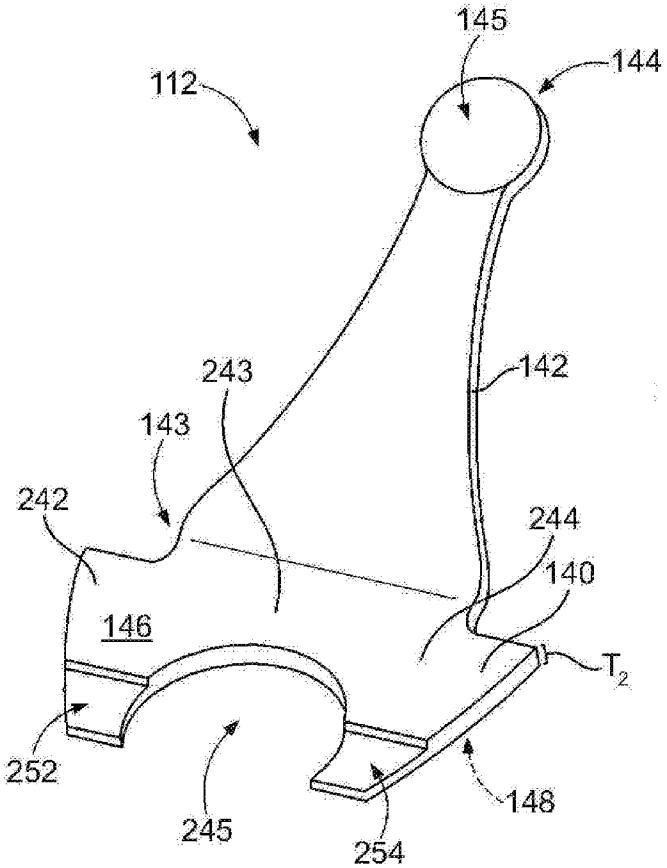
FIG. 5 illustrates an individual electrical contact according to one embodiment.

In some embodiments, the pad thickness $T_1$ may be about 150% the size of a heel thickness $T_2$ (shown in FIG. 5) of a contact heel 140 (FIG. 5). The pad thickness $T_1$ may be about 0.050 mm to about 0.100 mm and, more particularly, about 0.075 mm. In an exemplary embodiment, the conductive pads 168 include copper or copper alloy and, optionally, an organic solderability preservative (OSP) coating. Other corrosion-inhibiting, non-metallic materials may be used.

Although the above describes particular configurations for the conductive pads 168, it should be noted that the conductive pads 168 shown in FIG. 3 are only exemplary and that conductive pads of other embodiments may have different configurations.

Figure 4:
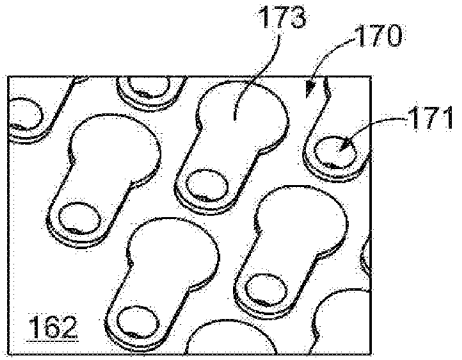
FIG. 4 is a bottom perspective view of the substrate and also shows an enlarged portion of the substrate with conductive pads in greater detail.
Figure 4:
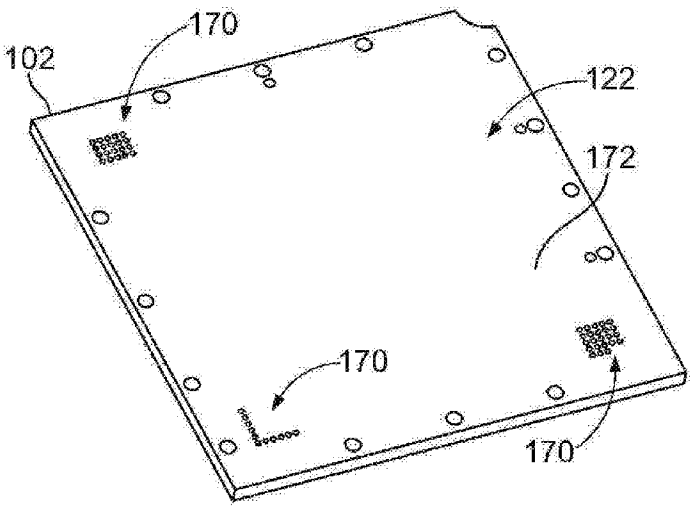
Figure 8:
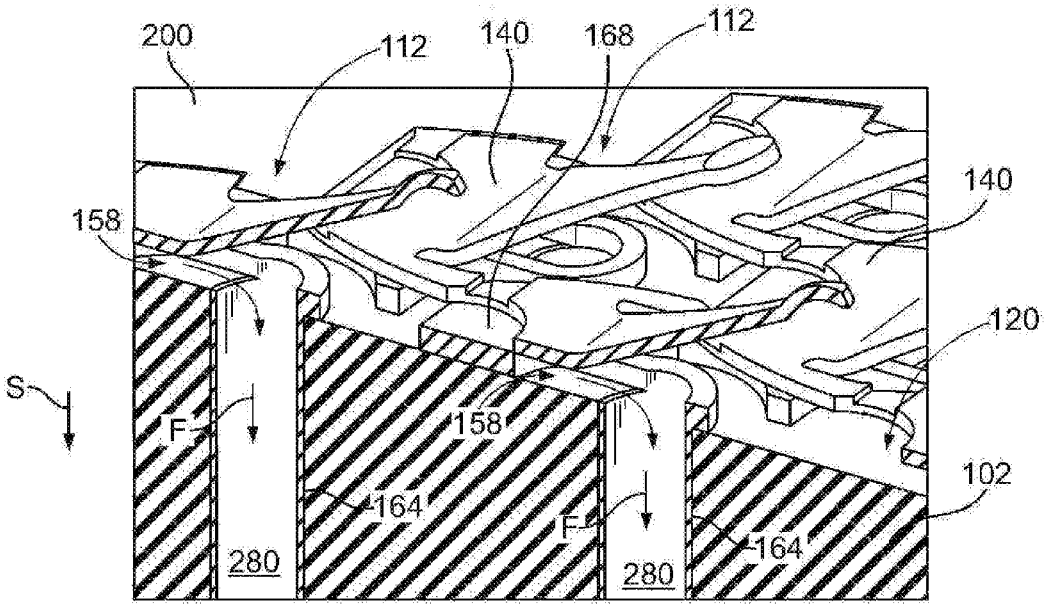
FIG. 8 is a perspective cross-sectional view of the plate mounted to the substrate during the manufacture of the electrical component of FIG. 1.

FIG. 4 is a perspective view of the second side 122 of the substrate 102. FIG. 4 also includes an enlarged view of conductive pads 170 on a second surface 162 of the substrate 102. The second surface 162 faces in an opposite direction with respect to the first surface 160 (FIG. 2). The second side 122 may include a solder mask 172 that is provided over the second surface 162 and may also extend partially over the conductive pads 170. As shown, the conductive pads 170 have an opening 171. The opening 171 provides access to a corresponding via 164 (FIG. 8). The conductive pads 170 also include a land area 173. The land area 173 is configured to engage another electrical contact. For example, in some embodiments, the land area 173 is configured to be coupled to a solder ball, such as the solder ball 513 shown in FIG. 10. In alternative embodiments, the conductive pads 170 may be similar to the conductive pads 168 (FIG. 2) described above and configured to engage electrical contacts like the electrical contacts 112 (FIG. 1).

FIG. 5 shows in greater detail the various features of one electrical contact 112. The electrical contact 112 may include the contact heel 140 and a contact beam 142 that extends away from the contact heel 140. In an exemplary embodiment, the contact heel 140 is configured to be positioned directly on and connected to the conductive pad 168 (FIG. 2). The contact heel 140 may be substantially planar and have the heel thickness $T_2$. Although not required, the contact heel 140 may have a similar geometric shape as the conductive pad 168, but without a suction channel. In the illustrated embodiment, the contact heel 140 includes two leg portions 242, 244 and a center portion 243 that joins the leg portions 242, 244. The leg and center portions 242, 244, 243 may define a heel recess or cut-out 245. As shown, the leg portions 242, 244 include weakened or thinned regions 252, 254 where the thickness $T_2$ of the contact heel 140 has been reduced.

The contact beam 142 extends to a distal end or tip 144. The tip 144 defines a separable interface for interfacing with the electronic package (not shown) that is received by the electrical component 100 (FIG. 1). The contact beam 142 and the contact heel 140 are connected to each other by a joint 143. In an exemplary embodiment, the contact beam 142 is bent at the joint 143 to extend at a non-orthogonal angle with respect to the contact heel 140. The contact beam 142 may be substantially linear from the joint 143 to the tip 144 or have only a small radius of curvature. However, in other embodiments, the contact beam 142 may be shaped to include sharp bends and the like.

Optionally, the tip 144 may be formed to have a convex shape. The outer surface of the tip 144 defines a wiping surface 145 for wiping against a corresponding contact surface (not shown) of the electronic package. In the illustrated embodiment, the tip 144 has a truncated spherical shape with the wiping surface 145 being bulged outward. The tip 144 may have other shapes in alternative embodiments. The contact heel 140 also has an upper surface 146 and a lower surface 148. The lower surface 148 defines a mounting surface for mounting the electrical contact 112 to the corresponding conductive pad 168. In an exemplary embodiment, the lower surface 148 is configured to be laser-welded to the conductive pad 168 at one or more weld points (or plug-weld bonds).

The electrical contact 112 (and the conductive pad 168 (FIG. 2)) may be manufactured from a conductive material, such as copper or a copper alloy. Portions of the electrical contact 112 may be plated. For example, the upper surface 146 and the contact beam 142 may be nickel plated. The tip 144 may be plated with hard gold. Optionally, the lower surface 148 may not be plated.

In particular embodiments, the electrical contact 112 comprises a phosphor bronze material (Sn 8%) and may include a finishing that has from about 0.001 mm to about 0.003 mm Ni plating.

Figure 6:
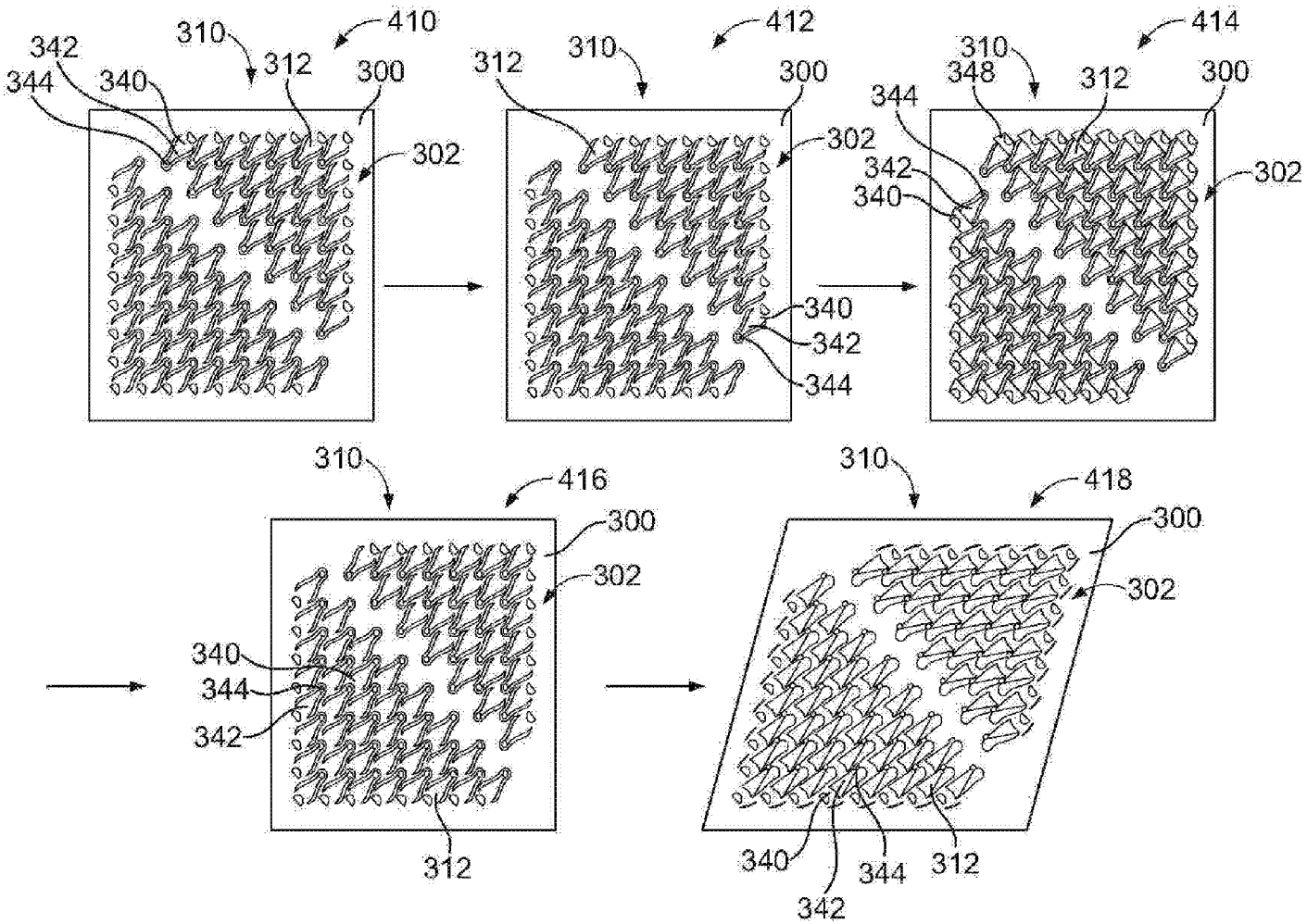
FIG. 6 illustrates a process for manufacturing a metal plate to form a contact array having a plurality of the electrical contacts.

FIG. 6 illustrates a process for manufacturing a metal plate 300 to form a contact array 310 having a plurality of electrical contacts 312. The contact array 310 is similar to the contact array(s) 110 shown in FIG. 1, and the electrical contacts 312 are similar to the electrical contact 112 (FIG. 1). At least portions of the process illustrated in FIG. 6 are described in greater detail in U.S. application Ser. No. 12/973,071, which is incorporated by reference in the entirety. Before processing the plate 300, the plate 300 may include a conductive sheet of material (e.g., a copper alloy sheet) that has predetermined dimensions. As shown in FIG. 6, the plate 300 is etched during an etching stage 410 to define a plurality of the electrical contacts 312 and a carrier 302 having the electrical contacts 312 coupled thereto. The etching stage 410 may be chemical etching or another type of etching in an alternative embodiment. In some embodiments, weld holes, such as the weld holes 282, 284 shown in FIG. 9, may be made in the electrical contacts 312 during the etching stage 410. Other processes may be used to begin forming the electrical contacts 312 from the plate 300, such as a stamping process or a laser-cutting process.

As shown, the electrical contacts 312 and the carrier 302 lie within a common plane of the plate 300 after the etching stage 410. Portions of the electrical contacts 312 are connected to the carrier 302 such that each of the electrical contacts 312 is connected to the other electrical contacts 312 through the carrier 302. The carrier 302 will later be removed after the electrical contacts 312 are singulated from the carrier 302 (e.g., by laser-cutting). The etching stage 410 generally defines the various structural features of the electrical contacts 312 as described above with respect to the electrical contact 112 in FIG. 5.

After the etching stage 410, the plate 300 may optionally undergo a tip-forming process at a tip-forming stage 412. The plate 300 may then undergo one or more plating processes as shown at plating stages 414, 416. During the first plating process, the plate 300 is nickel-plated all over the plate 300, except on a lower surface 348 of contact heels 340. The lower surface 348 of the contact heels 340 remain unplated such that the copper is exposed. Other portions may not be plated in alternative embodiments. Moreover, the plate 300 may be plated with a material other than nickel in alternative embodiments.

During the plating stage 416, tips 344 of the electrical contacts 312 are plated with a hard gold. However, the tips 344 may be plated with a different material in alternative embodiments. Optionally, the plating stages 414, 416 may use a photolithographic process, such as a dry film photoresist plating process.

The plate 300 undergoes a beam-forming process at a beam-forming stage 418. During the beam-forming stage 418, contact beams 342 of the electrical contacts 312 are bent out of the plane of the plate 300. The contact beams 342 are bent upward from the contact heels 340 to a predetermined angle. For example, the contact beams 342 may be bent to approximately a 30-60° angle with respect to the plane defined by the plate 300.

Figure 7:
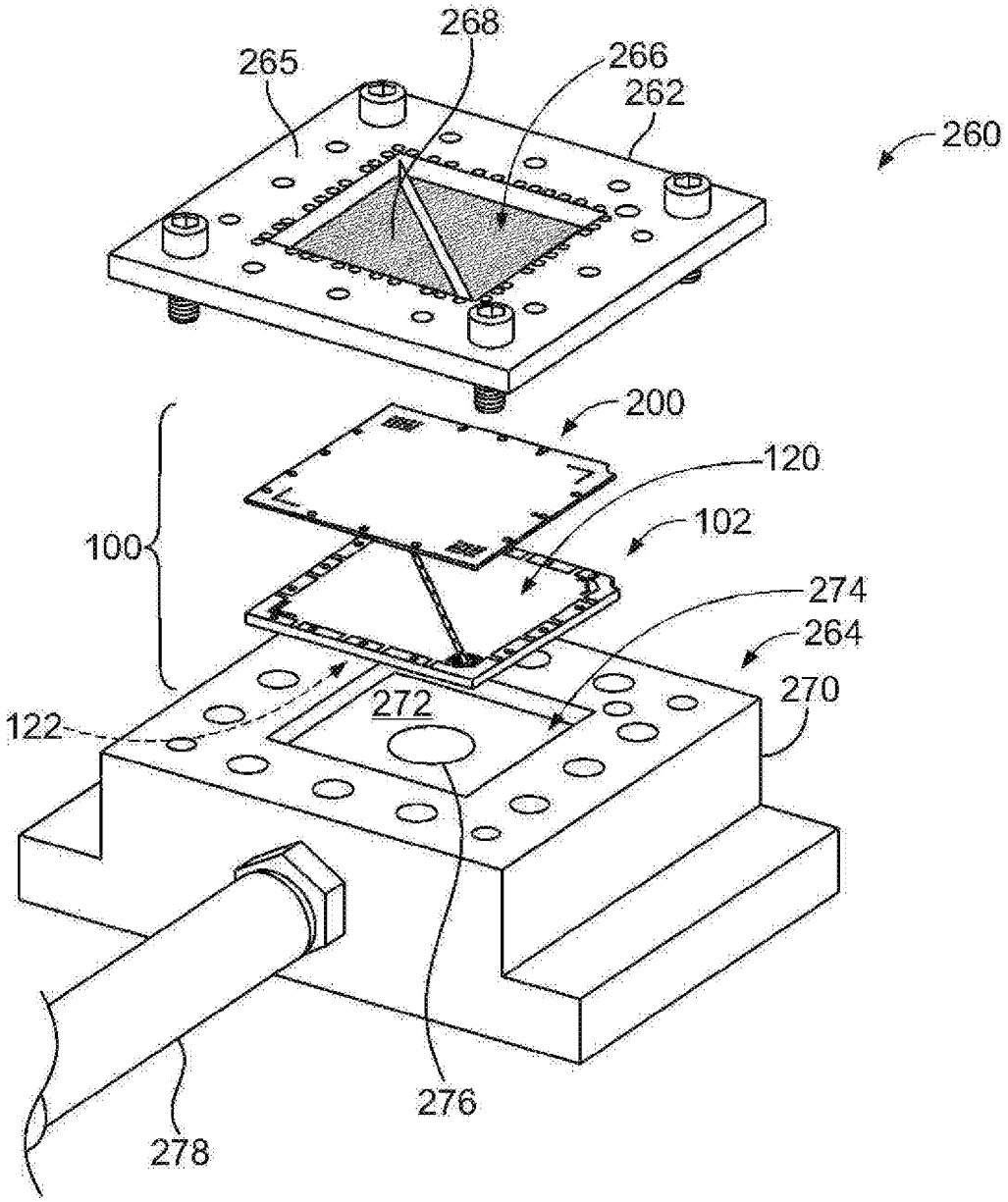
FIG. 7 is an exploded view of a contact-coupling assembly that may be used to couple electrical contacts to the substrate to form the electrical component of FIG. 1.

FIG. 7 is an exploded view of a contact-coupling assembly 260 that may be used to couple the electrical contacts 112 (FIG. 1) to the substrate 102 to form the electrical component 100. The contact-coupling assembly 260 includes a hold-down fixture 262 and a vacuum base 264. During formation of the electrical component 100, a metal plate 200 that is processed in a similar manner as described above with respect to FIG. 6 is held against the first side 120 of the substrate 102. The plate 200 includes the electrical contacts 112. In particular, the electrical contacts 112 are held against corresponding conductive pads 168 (FIG. 2) on the substrate 102. When held in a fixed position by the contact-coupling assembly 260, the electrical contacts 112 may then be coupled to the corresponding conductive pads 168 through a laser-welding process.

Holding the plate 200 against the first side 120 of the substrate 102 may be accomplished in various manners. For example, the hold-down fixture 262 includes a frame 265 that defines a window 266 where a screen or matrix 268 is located. The screen 268 includes a plurality of links that define beam openings. When the hold-down fixture 262 is mounted to the vacuum base 264, the screen 268 presses the plate 200 against the first side 120. The beam openings of the screen 268 are sized to allow a welding beam to be directed therethrough onto the electrical contacts 112.

In some embodiments, the plate 200 is held by only pressing the plate 200 against the first side 120 with the hold-down fixture 262. However, in particular embodiments, the plate 200 is pressed against the first side 120 by the hold-down fixture 262 and is also drawn toward the first side 120 by a suction force provided through the vacuum base 264. For example, the vacuum base 264 may include a body 270 that defines a reception area 272. The reception area 272 is configured to receive the substrate 102 and interface with the second side 122. In the illustrated embodiment, the reception area 272 is located within a base recess 274 that is sized and shaped in a similar configuration as the substrate 102. However, in other embodiments, the vacuum base 264 does not include the base recess 274.

The body 270 may include at least one suction passage 276 that opens to the reception area 272 and also a hose 278 that is fluidly coupled to the passage 276. The hose 278 is operatively coupled to a vacuum (not shown). During operation of the vacuum, air is drawn through the passage 276 and through the vias 164 (shown in FIG. 8) of the substrate 102. A low pressure is provided within the via 164 that generates a suction force in the suction channel 158 (FIG. 3). The suction force may facilitate holding the plate 200 against the first side 120 of the substrate 102. Although the vacuum method for holding the plate 200 against the first side 120 is described in conjunction with the hold-down fixture 262, the vacuum base 264 may be used exclusively to hold the plate 200 in a predetermined position.

FIG. 8 is a perspective cross-sectional view of the plate 200 mounted to the substrate 102 during the manufacture of the electrical component 100 (FIG. 1). As shown, the substrate 102 may include a plurality of the vias 164. Each of the vias 164 is electrically coupled to one of the conductive pads 168 at one end and to one of the conductive pads 170 (FIG. 4) at the other end. The vias 164 include respective air passages 280 that extend between the first and second sides 120, 122 (FIG. 1) of the substrate 102. The suction channels 158 are defined and located between the corresponding contact heels 140 and the substrate 102. When the vacuum (not shown) is operated, air is drawn through the passages 280. In other words, the passages 280 have a lower air pressure than the exterior of the first side 120 and the suction channel 158. When the air is drawn through the suction channel 158 as indicated by the arrows F into the passage 280, a suction force S pulls the plate 200 against the first side 120. More specifically, the contact heels 140 of the electrical contacts 112 are pressed against corresponding conductive pads 168.

In the illustrated embodiment, the vias 164 extend entirely through the substrate 102 between the first side 120 and the second side 122 (FIG. 1). However, in alternative embodiments, the vias 164 extend only partially therebetween from the first side 120 to an internal layer (not shown). The internal layer may include a conductive trace or another conductive component. The conductive trace may be electrically coupled to, for example, a conductive pad 170 on the second side 122. Alternatively, the conductive trace may be electrically coupled to a remote contact (not shown) located on the first side 120.

Figure 9:
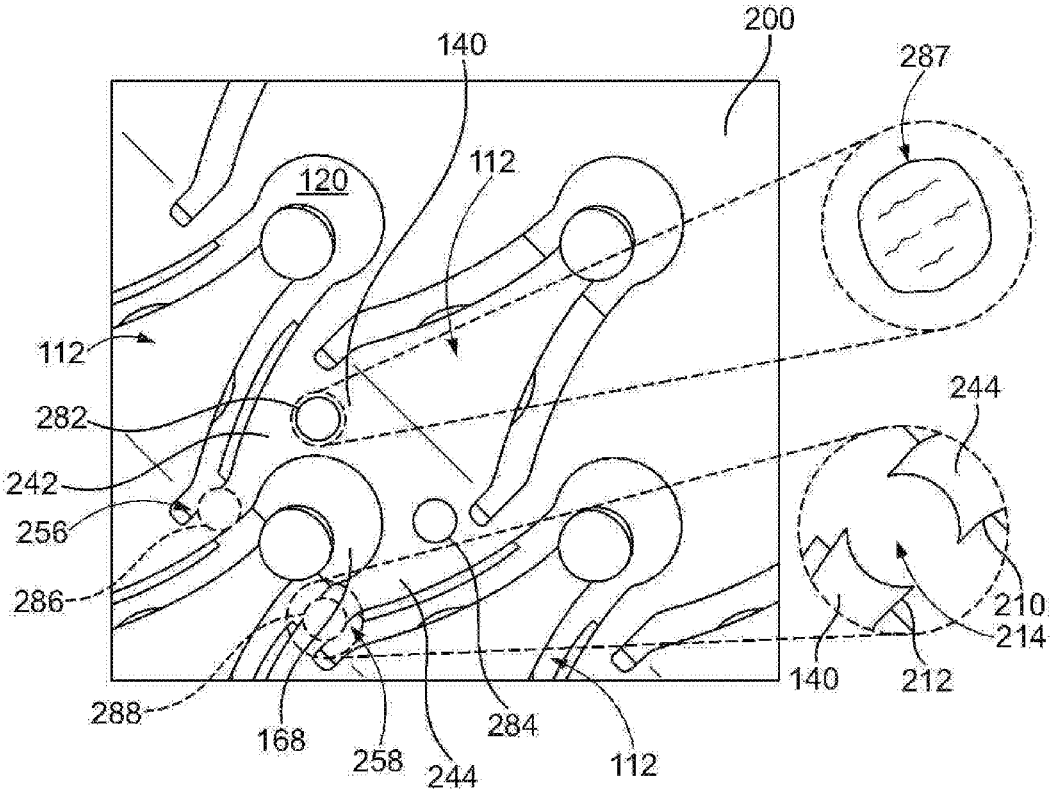
FIG. 9 is a top plan view of the electrical component before the electrical contacts are coupled to corresponding conductive pads and separated from each other.

FIG. 9 is a top plan view of a portion of the electrical component 100 (FIG. 1) before the electrical contacts 112 are laser-welded to corresponding conductive pads 168. When the plate 200 is loaded onto the first side 120, the electrical contacts 112 are aligned with and are positioned upon corresponding conductive pads 168. Once aligned, the plate 200 may undergo a welding process to weld the electrical contacts 112 to the corresponding conductive pads 168. The plate 200 may also undergo a singulation process to separate the individual electrical contacts 112 from each other. In an exemplary embodiment, the electrical contacts 112 are first welded to the conductive pads 168 and are then singulated. However, in alternative embodiments, the electrical contacts 112 may be separated from each other and then welded to the corresponding conductive pads 168. In such cases, an adhesive and/or a structure for pressing the electrical contacts 112 against the corresponding conductive pads 168 may be used.

In an exemplary embodiment, the electrical contacts 112 are laser-welded to the conductive pads 168. By way of one example, when the plate 200 is held by the contact-coupling assembly 260 (FIG. 7), a welding laser beam (not shown) may be directed through the openings (not shown) of the screen 268 (FIG. 7). The welding beam is directed to be incident upon the contact heel 140 at one or more beam spots.

In particular embodiments, the contact heel 140 is laser-welded to the conductive pad 168 using a plug-welding process. As described above, each of the contact heels 140 may include one or more weld holes, such as weld holes 282, 284 shown in FIG. 9. The weld holes 282, 284 extend into the thickness $T_2$ (FIG. 5) of the contact heel 140. In some embodiments, the weld holes 282, 284 may extend entirely through the thickness $T_2$ such that a portion of the conductive pad 168 underneath the contact heel 140 is exposed through the weld holes 282, 284. In the illustrated embodiment, the weld hole 282 is located proximate to the leg portion 242 and the weld hole 284 is located proximate to the leg portion 244. In other embodiments, the weld holes 282, 284 may have other locations depending upon the configuration of the contact heel 140. Moreover, only one weld hole may be formed in other embodiments.

To weld the contact heel 140 to the conductive pad 168, a welding beam (e.g., 532 nm) may be directed into the weld hole 282 or the weld hole 284 to a beam spot that is incident upon the contact heel 140 and/or the conductive pad 168. Heat is generated around the beam spot in the contact heel 140 and the conductive pad 168. The material of the contact heel 140 and the material of the conductive pad 168 may melt together and form a material "puddle" around where the beam spot is located. Subsequent cooling of the material puddle forms a mechanical and electrical connection (i.e., a metallurgical bond) between the metal materials of the contact heel 140 and the conductive pad 168. This metallurgical bond may be referred to as a plug-weld bond 287. The plug-weld bond 287 is shown in an enlarged portion of FIG. 9. In an exemplary embodiment, the contact heel 140 may have two or three plug-weld bonds 287 that are located on the contact heel 140 for stability of the electrical contact 112. For example, each of the leg portions 242, 244 may include a plug-weld bond 287 or have a plug-weld bond 287 proximate thereto. In other embodiments, each of the leg portions 242, 244 may include more than one plug-weld bond 287.

In some cases, the plug-weld bond 287 may be identifiable through inspection of the electrical contact 112 using, for example, a scanning electron microscope (SEM) or other microscope. For instance, the surface of the contact heel 140 at the plug-weld bond 287 may be morphologically uneven or have changes in color, changes in luster, or some other identifiable change with respect to the surrounding area that is indicative of a plug-weld bond. By way of one example, the plug-weld bond 287 may have a recessed surface with respect to the surrounding area of the contact heel 140. The changes may also be identified when viewing a cross-section of the welded contact heel 140 and conductive pad 168.

The diameter of the beam spot and the various dimensions of the contact heel 140 and the conductive pads 168 may be configured to provide suitable plug-weld bonds. For instance, the welding beam may have a beam diameter that is greater than or less than a diameter of the weld holes 282, 284. For example, the weld holes may have a diameter that is about 0.050 to about 0.100 mm and, more particularly, about 0.075 mm. The beam diameter may be about 0.030 mm to about 0.050 mm or, more particularly, about 0.040 mm. In some embodiments, the diameter of the weld hole may be about twice the diameter of the welding beam (or, more specifically, the diameter of the beam spot). The thickness $T_2$ of the contact heel 140 may be about 0.030 to about 0.070 mm and, more particularly, about 0.050 mm. The diameter of the weld hole may be about 150% the thickness $T_2$ of the contact heel 140 and about equal to the thickness $T_1$ (FIG. 3) of the conductive pad 168.

In other embodiments, the contact heel 140 is laser-welded to the conductive pad 168 using a lap-welding process. The material of the contact heel 140 may at least partially transmit the welding beam. For example, a 532 nm wavelength (green) laser may be used that is only partially absorbed by the contact heel 140. The laser beam may be directed to separate beam spots, which may have locations that are similar to the locations of the weld holes 282, 284, although no weld holes may be used in this embodiment. A heat spot (not shown) may be generated at an interface between the contact heel 140 and the conductive pad 168. Thermal energy generated at the heat spot causes the contact heel 140 and the conductive pad 168 to melt. Subsequent cooling forms a mechanical and electrical connection (i.e., a metallurgical bond) between the metal materials of the contact heel 140 and the conductive pad 168.

The welding beams may be from the same laser beam applied at different times to the beam spots or welding beams from separate lasers may be used. In the lap-welding embodiment, the welding beam(s) may be partially transmitted through the leg portions 242, 244 such that corresponding beam spots are also formed upon the wing portions 182, 184 (FIG. 3). After a predetermined period of time or a predetermined number of pulses from the welding beam, the energy may be removed and the heat spots allowed to cool.

Thus, each of the above laser-welding processes may join the leg portion 242 to the wing portion 182 and may join the leg portion 244 to the wing portion 184 through separate metallurgical bonds. As described above, laser-welded bonds may be distinguished from other types of mechanical and electrical bonds (e.g., bonds formed through soldering) upon inspection of the electrical component 100. For example, inspection of the electrical component 100 may be through use of a scanning electron microscope (SEM) or other microscope. Metallurgical bonds at the heat spots may be more cohesive or stronger than the metallurgical bonds away from the heat spots. In some cases, it may be possible to distinguish the separate metallurgical bonds.

Before, after, or during the formation of the metallurgical bonds described above, the electrical contacts 112 may be singulated from each other. As shown, the leg portions 242, 244 extend toward different electrical contacts 112 that are adjacent to each other. Sacrificial segments 256, 258 of the leg portions 242, 244 extend toward and join the contact heel 140 to two different electrical contacts 112. The sacrificial segments 256, 258 may include the thinned regions 252, 254 (FIG. 5) where the heel thickness $T_2$ (FIG. 5) is reduced. To separate the electrical contacts 112 from one another, a laser removal beam may be directed toward the sacrificial segments 256, 258. The removal beam may be the same type of laser beam used to weld the electrical contacts 112 or may be a different type. The removal beam(s) form beam spots 286, 288 on the sacrificial segments 256, 258, respectively. In the illustrated embodiment, the beam spots 286, 288 have a diameter that is greater than a width of the sacrificial segments 256, 258. In such embodiments, the sacrificial segments 256, 258 may be removed without moving the laser beam and the electrical contacts 112 relative to each other during the removal process.

After removing the sacrificial segments 256, 258, at least some of the electrical contacts 112 may include structural features that are indicative of the electrical contacts 112 being joined at one time to adjacent contacts. More specifically, material remnants of the sacrificial segments 256, 258 may remain or portions of the conductive pads 168 may have structural changes where the laser beam that removed the sacrificial segments 256, 258 was incident upon the conductive pads 168.

For example, a cut-away portion of FIG. 9 shows two remnant structures 210 and 212. The remnant structure 210 is from the leg portion 244 from one electrical contact 112, and the remnant structure 212 is from the contact heel 140 of an adjacent electrical contact 112. The remnant structure 210, 212 extend toward each other and have a sacrificial spot 214 that exists between the remnant structures 210, 212. When viewed together, the remnant structures 210, 212 have characteristics that are indicative of the remnant structures 210, 212 being removed from a laser-cutting (or singulation) process. Accordingly, the contact heels 140 of adjacent electrical contacts 112 may have remnant structures 210, 212 that are indicative of the contact heels 140 being previously joined by a carrier, such as the carrier 302 (FIG. 6). Other characteristics of the electrical component 100 may also be indicative of a past singulation process for separating electrical contacts 112 from the same carrier.

After the electrical contacts 112 are singulated, a coverlay (not shown) may be loaded onto the first side 120. The coverlay may define a spacer for the electrical contacts 112 so that the electrical contacts 112 do not bottom out against the substrate 102 when the electronic package is mounted to the electrical component 100. The coverlay includes openings so that when the coverlay is moved onto the first side 120, the contact beams 142 (FIG. 5) extend through the openings of the coverlay. The coverlay may extend over the contact heels 140 (FIG. 5) of the electrical contacts 112. A similar coverlay is described in greater detail in U.S. application Ser. No. 12/973,071, which is incorporated by reference in the entirety.

Figure 10:
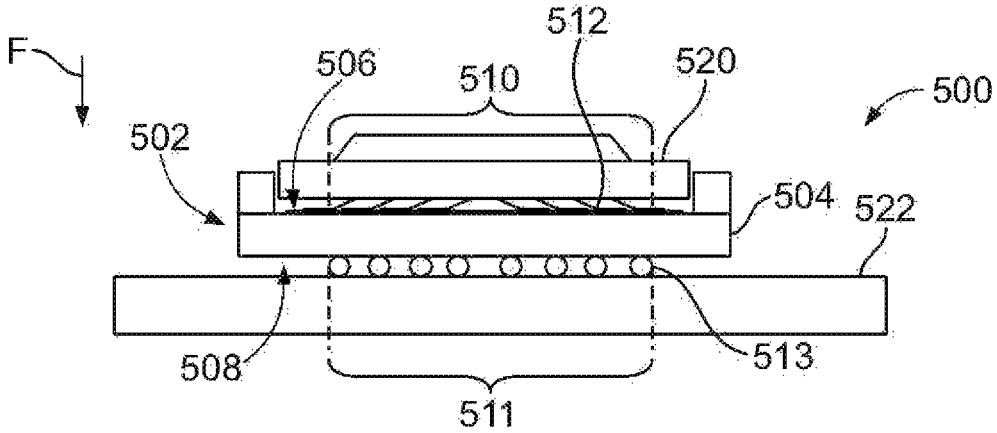
FIG. 10 is a side view of a communication assembly that includes the electrical component of FIG. 1.

FIG. 10 is a side view of a communication assembly 500 that includes an electronic package 520 having an underside with package contacts, a circuit board 522, and an electrical component 502 that interconnects the package 520 and the circuit board 522. The electrical component 502 may be similar to the electrical component 100 (FIG. 1). As shown, the electrical component 502 includes a substrate 504 having opposite first and second sides 506, 508 and a plurality of vias (not shown) extending therethrough between the first and second sides 506, 508. The substrate 504 has a contact array 510 that is mounted to the substrate 504 along the first side 506, and a contact array 511 that is mounted to the substrate 504 along the second side 508. The contact array 510 has a plurality of electrical contacts 512, and the contact array 511 has a plurality of electrical contacts 513. In the illustrated embodiment, the electrical contacts 513 are solder ball contacts.

Each of the electrical contacts 512 may be similar to the electrical contacts 112 (FIG. 1) and include a contact heel and a contact beam that extends from the corresponding contact heel and at least partially away from the first side 506. The electrical contacts 512 are laser-welded to the substrate 504 as described above. In the illustrated embodiment, the electrical component 502 is a land grid array (LGA) interconnect that is configured to engage the package 520 of the communication assembly 500 and communicatively couple the package 520 to the circuit board 522. More specifically, a retention force F is applied to the package 520 by a suitable retention mechanism (not shown) to bias the package 520 against the electrical component 502, whereby package contacts of the package 520 engage and deflect the electrical contacts 512, thereby electrically connecting the package contacts of the package 520 to the electrical contacts 512. The electrical component 502 also has a ball grid array of electrical contacts 513.

Figure 11:
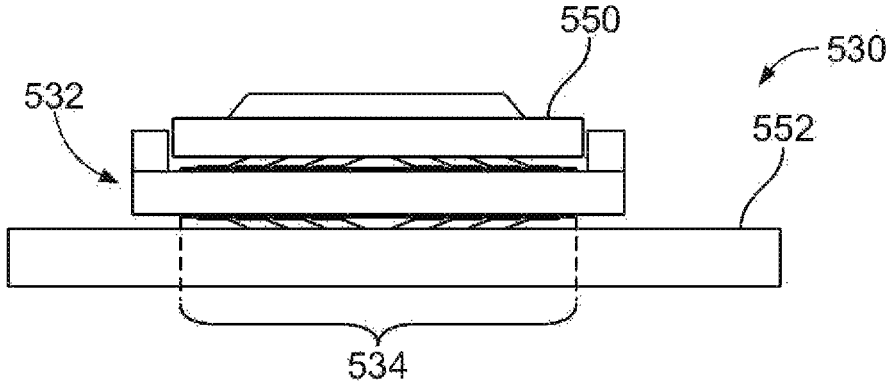
FIG. 11 is a side view of a communication assembly that includes an electrical component formed in accordance with one embodiment.

FIG. 11 is a side view of a communication assembly 530 that includes an electronic package 550, a circuit board 552, and an electrical component 532 that interconnects the package 550 and the circuit board 552. The communication assembly 530 is similar to the communication assembly 500. However, the electrical component 532 includes a contact array 534 along the second (or bottom) side. The contact array 534 is an LGA that is similar to the contact arrays 110 and 510 described above.

Figure 12:
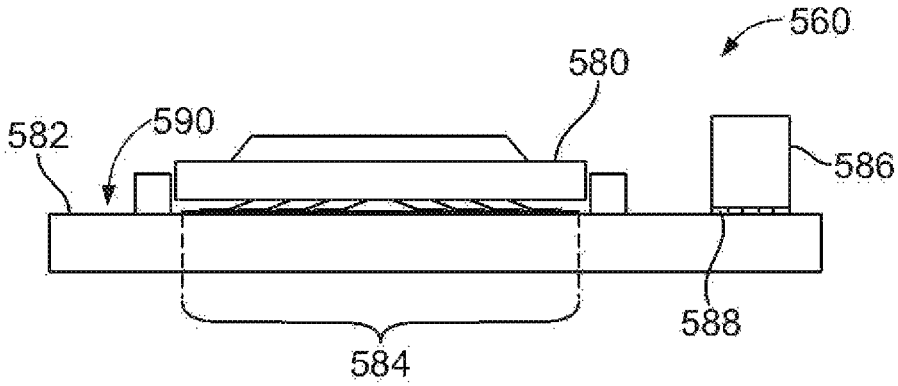
FIG. 12 is a side view of an electrical component formed in accordance with one embodiment that is part of a communication assembly.

FIG. 12 is a side view of a communication assembly 560 that includes an electronic package 580, a circuit board 582 having a contact array 584, and an electrical connector 586 that is mounted to the circuit board 582. The circuit board 582 may be, for example, a motherboard or other primary circuit board used in a system that interconnects other components. The contact array 584 may be directly laser-welded to the circuit board 582 without an intervening substrate or interconnect therebetween. The contact array 584 is similar to the contact array 110 (FIG. 1) and interconnects the package 580 and the circuit board 582. The circuit board 582 has remote contacts 588 along a side 590 of the circuit board 582 that are configured to engage the electrical connector 586. The remote contacts 588 are communicatively coupled to the contact array 584 through traces (not shown) of the circuit board 582.

As used herein, an element or step recited in the singular and proceeded with the word "a" or "an" should be understood as not excluding plural of said elements or steps, unless such exclusion is explicitly stated. Furthermore, references to "one embodiment" or "an embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional elements not having that property.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. An electrical component comprising:

a substrate having opposite first and second sides and a plurality of vias extending into the substrate from the first side, the substrate having conductive pads on the first side that are electrically connected to corresponding vias and extend from the corresponding vias over a substrate surface of the first side of the substrate; and a plurality of electrical contacts mounted to the substrate along the first side, each of the electrical contacts including a contact heel and a contact beam that extends from the corresponding contact heel and at least partially away from the first side, wherein the contact heels are laser-welded to corresponding conductive pads on the first side to form plug-weld bonds that are located over the substrate surface, wherein the conductive pads have a pad thickness and the contact heels have a heel thickness, the pad thickness being greater than the heel thickness, wherein each of the contact heels includes first and second leg portions and a center portion that extends between and joins the first and second leg portions, the first and second leg portions extending toward different electrical contacts, each of the first and second leg portions having at least one of the plug-weld bonds.

2. The electrical component of claim 1, wherein the contact heels and the conductive pads comprise copper or copper alloy.

3. The electrical component of claim 1, wherein each of the contact heels is laser-welded to the corresponding conductive pad on the first side at a plurality of separate points to have a plurality of the plug-weld bonds.

4. The electrical component of claim 1, wherein the conductive pads on the first side have a pad thickness and the contact heels have a heel thickness, the pad thickness being at least about 1.25 times the heel thickness.

5. The electrical component of claim 1, wherein the contact heels of adjacent electrical contacts have remnant structures that are indicative of the contact heels being previously joined by a carrier.

6. The electrical component of claim 1, wherein the substrate has conductive pads on the second side that are electrically connected to corresponding vias and corresponding conductive pads on the first side.

7. The electrical component of claim 1, wherein the electrical component is a land grid array (LGA) interconnect configured to engage an electronic package along the first side and communicatively couple the electronic package to a circuit board along the second side.

8. The electrical component of claim 1, wherein the plurality of electrical contacts form a first contact array, the substrate having conductive pads on the second side that are electrically connected to corresponding vias and corresponding conductive pads on the first side, the electrical component further comprising a second contact array of electrical contacts coupled to corresponding conductive pads along the second side, each of the electrical contacts of the second contact array including a contact beam that extends at least partially away from the second side.

9. The electrical component of claim 1, wherein the plurality of electrical contacts form a first contact array and the electrical component comprises a second contact array mounted to the substrate along the second side, the second contact array having a plurality of solder ball contacts coupled to corresponding second conductive pads along the second side.

10. The electrical component of claim 1, wherein the substrate comprises a printed circuit board.

11. The electrical component of claim 1, wherein the plurality of electrical contacts form a contact array having first, second, and third contact rows of the electrical contacts in which the second contact row is located between the first and third contact rows, the contact beams having distal ends and the first and second leg portions defining a cut-out therebetween, wherein the distal ends of the electrical contacts of the first contact row are formed from material located between the first and second leg portions of the electrical contacts of the third contact row.

12. The electrical component of claim 1, wherein the contact heels have top surfaces that include recessed portions, the plug-weld bonds including the recessed portions.

13. The electrical component of claim 1, wherein each of the conductive pads has a pair of wing portions that extend away from each other and a width that is measured between opposite edges of the wing portions, wherein the width of the corresponding conductive pad decreases as the corresponding conductive pad extends away from the corresponding via to which the conductive pad is electrically connected.

14. An electrical component comprising:

a substrate having opposite first and second sides and a plurality of vias extending into the substrate from the first side, the substrate having conductive pads on the first side electrically connected to corresponding vias; and a plurality of electrical contacts mounted to the substrate along the first side, each of the electrical contacts including a contact heel and a contact beam that extends from the corresponding contact heel and at least partially away from the first side, wherein the contact heels are laser-welded to corresponding conductive pads on the first side, wherein the conductive pads on the first side define suction channels that are located between the corresponding contact heels and the substrate, the vias including air passages extending into the substrate from the first side, the air passages being in fluid communication with the suction channels such that, when air is drawn through the air passages of the vias from the first side to the second side, a suction force presses the contact heels against the corresponding conductive pads.

15. An electrical component comprising:

a substrate having opposite first and second sides and a plurality of vias extending into the substrate from the first side, the substrate having conductive pads on the first side that are electrically connected to corresponding vias and extend from the corresponding vias over a substrate surface of the first side of the substrate; and a plurality of electrical contacts mounted to the substrate along the first side, each of the electrical contacts including a contact heel and a contact beam that extends from the corresponding contact heel and at least partially away from the first side, wherein the contact heels are laser-welded to corresponding conductive pads on the first side to form plug-weld bonds that are located over the substrate surface;

wherein the conductive pads on the first side include first and second rows of conductive pads, the conductive pads on the first side being staggered such that a conductive pad from the second row extends partially between adjacent conductive pads of the first row, wherein the via electrically connected to the conductive pad from the second row has an opening that is located between the adjacent conductive pads of the first row.

16. An electrical component comprising:

a substrate having a side that includes a plurality of conductive pads, the conductive pads located on a substrate surface of the side;

a plurality of electrical contacts coupled to the side of the substrate, each of the electrical contacts having a contact heel and a contact beam that extends from the corresponding contact heel and at least partially away from the side, wherein the contact heels are joined to the corresponding conductive pads by corresponding plug-weld bonds that are located over the substrate surface, wherein the conductive pads have a pad thickness and the contact heels have a heel thickness, the pad thickness being greater than the heel thickness, wherein each of the contact heels includes first and second leg portions and a center portion that joins the first and second leg portions, each of the first and second leg portions having at least one of the plug-weld bonds.

17. The electrical component of claim 16, wherein the conductive pad has a pad thickness and the contact heel has a heel thickness, the pad thickness being greater than the heel thickness.

18. An electrical component comprising:

a substrate having a side that includes a plurality of conductive pads, the conductive pads located on a substrate surface of the side;

a plurality of electrical contacts coupled to the side of the substrate, each of the electrical contacts having a contact heel and a contact beam that extends from the corresponding contact heel and at least partially away from the side, wherein the contact heels are joined to the corresponding conductive pads by corresponding plug-weld bonds that are located over the substrate surface, wherein each of the contact heels includes first and second leg portions and a center portion that joins the first and second leg portions, each of the first and second leg portions having at least one of the plug-weld bonds;

wherein the plurality of electrical contacts form a contact array having first, second, and third contact rows of the electrical contacts in which the second contact row is located between the first and third contact rows, the contact beams having distal ends and the first and second leg portions defining a cut-out therebetween, wherein the distal ends of the electrical contacts of the first contact row are formed from material located between the first and second leg portions of the electrical contacts of the third contact row.

* * * * *